US006095478A

United States Patent [19]

Barnes

[11] Patent Number: 6,095,478

[45] Date of Patent: Aug. 1, 2000

[54] PICTURE HANGING SYSTEM AND METHOD

[76] Inventor: Renny H. Barnes, 8228 Richmond Hwy., Alexandria, Va. 22309

[21] Appl. No.: 09/108,208

[22] Filed: Jul. 1, 1998

Related U.S. Application Data

[60] Provisional application No. 60/052,237, Jul. 11, 1997, and provisional application No. 60/058,440, Sep. 10, 1997.

[51] Int. Cl.[7] ..... A47F 7/14

[52] U.S. Cl. ..... 248/475.1; 248/216.1; 248/217.3

[58] Field of Search ..... 248/466, 475.1, 248/489, 493, 497, 498, 216.1, 216.4, 217.3, 217.2, 217.4

[56] References Cited

U.S. PATENT DOCUMENTS

| | | | |
|---|---|---|---|
| 2,639,529 | 5/1953 | Fox . | |
| 2,791,051 | 5/1957 | Scheyer . | |
| 3,966,157 | 6/1976 | Corral et al. | 248/217.3 |
| 4,613,108 | 9/1986 | Sundström et al. | 248/497 |
| 4,728,237 | 3/1988 | Lorinecz | 248/497 X |
| 5,267,718 | 12/1993 | Sheehan | 248/475.1 |
| 5,328,139 | 7/1994 | Barnes | 248/475.1 |
| 5,588,629 | 12/1996 | Barnes | 248/475.1 |
| 5,669,593 | 9/1997 | Kirchner | 248/489 X |

*Primary Examiner*—Ramon O. Ramirez
*Attorney, Agent, or Firm*—Clark & Brody

[57] ABSTRACT

A picture hanging system includes at least one slot in a picture frame rail, the slot angled with respect to vertical. At least one frame support is inserted in the slot and the picture frame is hung on a wall without the need for any tool. The support(s) has at least one wall engaging portion(s) which penetrates the wall when the picture frame is hung. The wall engaging portion is configured to have at least one planar surface which rests against a portion of the wall after picture hanging. The picture frame is hung flushly and securely so that it does not tilt or move after hanging. Other wall article can be hung besides picture frames.

21 Claims, 2 Drawing Sheets

FIG. 1
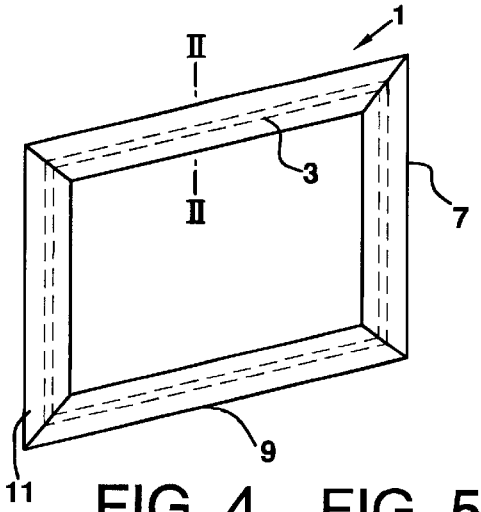
FIG. 2
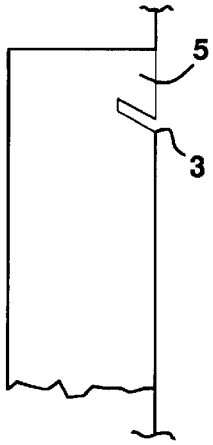
FIG. 3
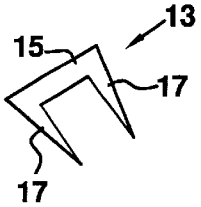
FIG. 4
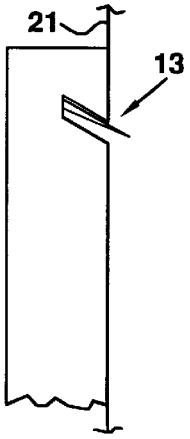
FIG. 5
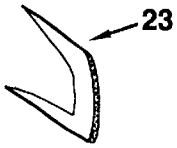
FIG. 6
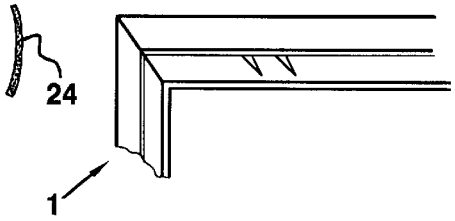
FIG. 7
FIG. 8
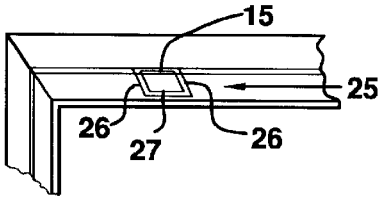
FIG. 9
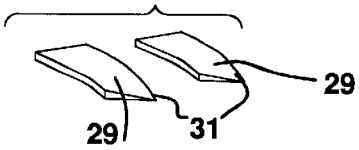
FIG. 10
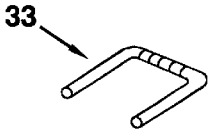
FIG. 11A
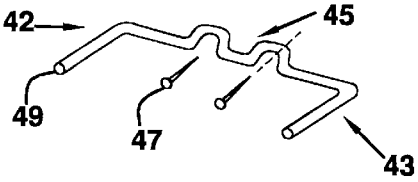
FIG. 11B
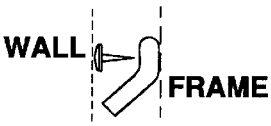

PICTURE HANGING SYSTEM AND METHOD

This application claims the benefit of provisional application Ser. No. 60/052,237 filed on Jul. 11, 1997 and 60/058,440 filed on Sep. 10, 1997.

FIELD OF THE INVENTION

The present invention is directed to a picture hanging system and method and, in particular, to a system and method which requires no tool(s) for picture hanging.

BACKGROUND ART

U.S. Pat. No. 2,791,051 to Scheyer discloses a flush mounted picture frame that employs a limited length slot in one of the frame rails. The slot is angled with respect to vertical. A nail is inserted into a wall surface and the picture frame is then hooked on the nail so that the nail enters the slot and an upper surface of the slot rests on the nail. The slot is sized to be larger than the nail. Two slots can be employed, one on the upper and lower rails, respectively, and a pair of nails can be used, the nails wedged in the slots by making the vertical spacing between the nails greater than the vertical spacing between the slots.

SUMMARY OF THE INVENTION

It is a first object of the invention to provide an improved picture hanging system.

Another object of the invention is to provide a picture hanging system that requires no tools for picture frame installation.

A further object of the invention is a system and method that provides flexibility in hanging different sized and weighted picture frames.

A still further object of the invention is a picture frame hanging system having an a slot, angled with respect to vertical in one embodiment, running along at least a portion of the length of one or more rails of the frame, the slot sized to engage and hold at least one picture frame support, when using one support, the support having at least two wall surface penetrating portions to attach to the wall surface and to support the picture frame. Multiple supports could be used, each having a unitary wall penetrating portion to frame support.

One other object of the invention is a system and method of hanging a picture frame wherein a picture frame is securely engaged to a wall surface so that the picture frame does not tilt or move after wall surface installation.

The invention also includes a wall article hanging device for attaching an article to a wall surface comprising an elongated wire, means for rigidly and flushly attaching the wire to a rear surface of the article, ends of the wire being angled downwardly with respect to a longitudinal axis of the wire so that each end can penetrate a wall surface after the wire is fastened to the article. The means may comprises one of fasteners and protrusions extending outwardly from the wire in a direction opposite the wire ends.

Other objects and advantages of the present invention will become apparent as a description proceeds.

BRIEF DESCRIPTION OF THE DRAWINGS

FIG. 1 is a perspective front view of a picture frame showing one aspect of the invention;

FIG. 2 is a cross sectional view along the line II—II of FIG. 1;

FIG. 3 is a perspective view of an exemplary frame support;

FIG. 4 is sectional view of the frame support of FIG. 3 in use;

FIG. 5 shows a second embodiment of the frame support;

FIG. 6 shows an end view of the frame support of FIG. 5;

FIG. 7 shows an end view of a picture frame using a frame support;

FIG. 8 is an end view of a third embodiment of the frame support;

FIG. 9 is a perspective view of a fourth embodiment of the frame support aspect of the invention;

FIG. 10 is a perspective view of a fifth frame support embodiment;

FIG. 11A and 11B are a perspective view and a side view respectively, of a picture hanging device of the invention;

DESCRIPTION OF THE PREFERRED EMBODIMENTS

Figure 12:
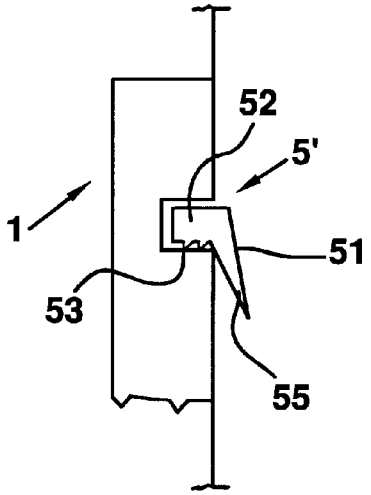
FIG. 12 is a partial sectional view of a fifth embodiment of the invention.

The invention is an improvement in picture hanging in that there is no need to use any type of a tool for installation. A picture frame can be hung according to the invention so that it is generally flush to a wall surface and is secured in a way so that the picture frame will not tilt or move over time.

The invention employs a slot in one or more of the frame rails of a picture frame. Also provided is one or more frame rail supports, each sized and configured to fit in a slot in the frame rail. As described in more detail below, the slot can be angled with respect to a wall surface, perpendicular, dovetailed or any other configuration which will permit receiving and/or holding one or more frame supports. When using an angled slot, the slot is angled with respect to vertical, up to 55°, preferably between 30 and 35°, as measured from an upper surface of the slot and the wall surface vertical. The slot can be formed in one rail of the picture frame, but can also be formed in more than one rail. For example, a slot could be formed in the upper and lower rails of the picture frame. Alternatively, a slot could be formed in three or four rails, and in all rails if the frame has more than four sides.

At least one picture frame support is provided for insertion or attachment in each slot. Means or wall engaging portion(s) to penetrate the wall surface for picture frame hanging are provided with each frame support. In one embodiment, the picture frame support and slot are sized so that a body of the support snugly fits within the slot. The snug fit can be a pressure fit wherein the support body is merely forced into the slot, the slot width being slightly smaller than the support body thickness, e.g., a plate like support with prongs or the like for wall penetration The support body could also have other shapes as long as the shape can interface with the slot for secure attachment thereto, e.g., an screw like body which can be threaded into the slot, a body having raised protrusions which, when forced into the slot would penetrate the slot walls, a curved body which will wedge in the slot or the like.

The support has at least one wall engaging portion. If more than one support is used, each support would have at least one wall engaging portion. If one support were used, the support would have at least a pair of wall engaging portions. The wall engaging portions are configured to penetrate the wall surface, e.g., have a generally pointed distal end. Using at least two wall engaging portion, whether as part of one support or more than one support, provides at least two points of attachment to the wall surface. These two points of attachment prevent or minimize picture frame tilting or movement after installation. In one embodiment, each of the wall engaging portions have a generally planar surface at least on an underside thereof so that the planar surface rests against a lip portion of the wall that is created when the wall engaging portion penetrates the wall surface. In this way, the support is not knife-like or edge-like, thereby avoiding the wall engaging portion from cutting downwardly through the wall due to the picture frame weight. Prongs as disclosed in U.S. Pat. Nos. 5,328,139 and 5,588,629 to Barnes are one type of a prong that can be used as the wall engaging portion(s), both patents herein incorporated by reference in their entirety. Of course, the planar surface could be rectangular, triangular or even trapezoidal providing that the distal end can penetrate the wall surface.

The support can be mounted to one or more rails. When mounting to the side rails, the support body should be configured so that the wall engaging planar surface still rests on the wall lip as described above. In other words, the portion of the wall engaging planar surface that rests on the wall lip is generally horizontal. For example, the body could be configured in a screw-like or other elongated shape which could then be inserted into the vertically running slot and the wall engaging portion(s) could then extend from the support body for wall penetration.

Formation of the slot can be done in any manner. To lower costs, the slot(s) could be cut into the rails during rail manufacture. Thus, the picture frame, when sold to a customer, would have the slot(s) already present. The customer would then only have to insert one or more of the supports in the slot(s), position the frame against the wall in the desired location, and push against the frame, whereby the wall engaging portions of the support(s) would penetrate the wall surface and the picture would be hung, generally flush and secure against tilting. Preferably, the slot is cut along the entire length of the rail since this would also reduce costs. However, the slot could be cut in the rail along only a portion of the rail length.

The picture frame can be leveled against the horizon using a leveling device prior to forcing the frame against the wall surface. Alternatively, the frame can be leveled against an adjacent piece of furniture as disclosed in U.S. Pat. No. 5,758,858, herein incorporated by reference in its entirety.

The drawings disclose different embodiments of the invention. FIGS. 1 and 2 illustrate a picture frame 1 with the slot 3 formed in all four frame rails 5,7,9,11. FIG. 3 illustrates an exemplary support 13 or hanger having a body 15 and two prongs 17. The body 15 is sized to be held in the slot without sliding therealong.

FIG. 4 shows the hanger 13 of FIG. 3 inserted into wall 21. FIGS. 5 and 6 show an alternative hanger 23 having a curved body portion 24 that lodges in the slot 3. The curved portion further engages the body portion 24 in the slot 3.

FIG. 7 is a rear view of the hanger 13 of FIG. 3 in the slot 3 of the picture frame 1. FIG. 8 shows yet another type of hanger 25 wherein the prongs are connected to form a bar 27 which can rest on a nail or other protrusion extending from a wall surface. In hanger 25, the body 15 is connected to the bar 27 via legs 26. With this configuration, the support can hook on a nail or the like protruding from a wall.

FIG. 9 shows a pair of hangers 29, each having a wall penetrating portion 31. FIG. 10 shows a hanger 33 made from a wire or staple.

FIG. 11A and 11B shows a hanger identified by reference number 42 as an alternative to the types disclosed in the two Barnes patents mentioned above. The plate like hangers disclosed in the Barnes patents are substituted with a wire 43. Loops 45 are used with the means 47, i.e., screws or nails, for fastening the hanger to a frame. The wire ends 49 are angled to penetrate a wall surface to hang a frame after the hanger 42 has been attached to the frame as is taught in the Barnes patents. The loops 45 can be replace with wire protrusions to engage a frame in place of the fasteners 47. In use, the hanger 42 is first attached to a rear of an article such as a picture frame and then the wire ends are inserted into a wall surface to hang the article. These improved hangers cost less to make than the hangers of the Barnes patents and do not require a plate shape for wall penetration.

The picture frame used in conjunction with the present invention can be leveled with respect to horizon or an adjacent piece of furniture using the device disclosed in U.S. Pat. No. 5,758,858 to Barnes. The teachings of this patent are hereby incorporated by reference in its entirety.

Figure 13:
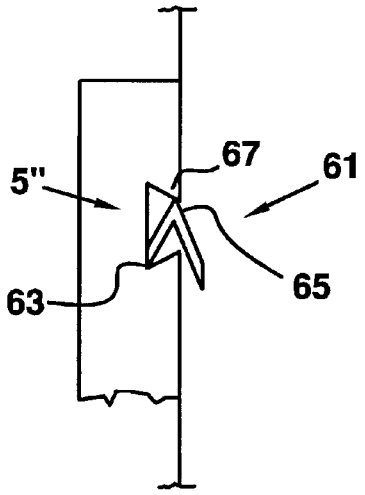
FIG. 13 is a partial sectional view of a sixth embodiment of the invention.
Figure 14:
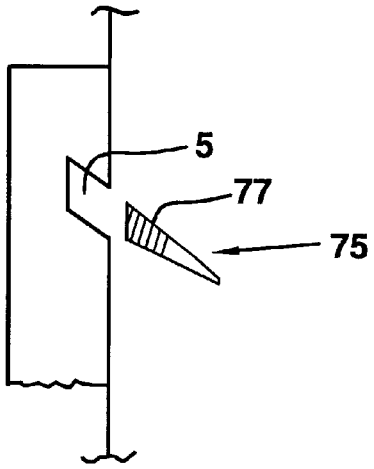
FIG. 14 is a partial sectional view of a seventh embodiment of the invention.
Figure 15:
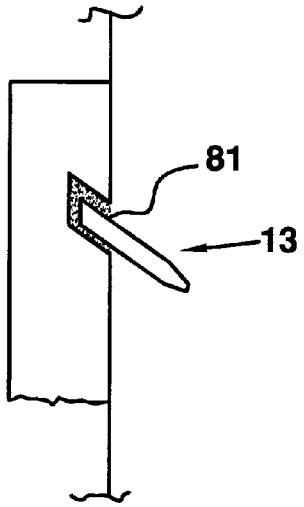
FIG. 15 shows the arrangement of FIG. 4 with an adhesive.

Referring to FIGS. 12 and 13, alternative slot configurations and supports are shown. In FIG. 12, a slot 5' is generally square in cross section and receives a support 51 having a body 52 sized to engage the slot 5' with a portion 55 protruding from the slot and angled to penetrate a wall surface. The body 52 can have barbs 53 to assist in engaging the slot 5'. However, other forms of engagement can be used to secure the body 52 in the slot 5'. FIG. 13 shows a dovetail slot 5" and a v-shaped support 61. The end 63 of the support 61 nests in the bottom of the slot 5" with the apex 65 being retained in the slot 5" by the frame portion 67, thereby wedging the support 61 in the dovetail. FIG. 14 shows a support 75 with a threaded end 77 for screwing into the slot 5. FIG. 15 shows the arrangement of FIG. 4 with an adhesive 81 in the slot 3.

The supports disclosed above can be made of any material, including a spring steel or the like to have flexibility for installation and removal and for the ability to handle impact when the frame may be jostled while attached to a wall surface.

Although frames are disclosed, other wall hanging articles such as shelves, shadow boxes and the like can employ the hanger system.

Accordingly, an invention has been disclosed in terms of preferred embodiments thereof which fulfill each and every one of the objects of the present invention as set forth above and provides a new and improved picture hanging system and method.

Various changes, modifications and alterations from the teachings of the present invention may be contemplated by those skilled in the art without departing from the intended spirit and scope thereof. Accordingly, it is intended that the present invention only be limited by the terms of the appended claims.

The invention claimed is:

1. A picture hanging system comprising:

a) at least one rail of a picture frame, the rail having a slot running along at least a portion of its longitudinal length; and b) at least one frame support, the support sized to fit snugly within the slot so that the support would not fall out of the slot by gravity or be easily moved laterally;

c) when using one support, the support has at least two wall engaging portions, each portion having at least one planar surface, the planar surface lying generally in the same plane as the slot when the support is inserted in the slot;

d) the support being inserted in the slot so that the wall engaging portions can engage a wall surface and the picture frame can be held thereagainst.

2. The system of claim 1, wherein more than one support is used.

3. The system of claim 1, wherein an upper and lower rail of the picture frame each include the slot, and a support is inserted in each slot.

4. The system of claim 1, wherein the slot is angled with respect to the vertical of the wall surface at an angle of up to 55°, preferably between 30° and 35°.

5. The system of claim 1, wherein the support is plate-like in shape and each wall engaging portion is a prong extending from a body of the plate.

6. The system of claim 5, wherein each prong is generally triangular in shape, one flat surface of the prong, preferably an upper flat surface, and the wall surface forming the acute angle.

7. The system of claim 1, wherein a plurality of supports are provided, each support inserted in one slot of the picture frame.

8. The system of claim 1, wherein the support has a body which is configured to screw into the slot.

9. The system of claim 1, wherein when more than one support is used in one slot, each support has at least one of the wall engaging portions.

10. The system of claim 1, wherein the support is fixed in the slot with an adhesive.

11. The system of claim 1, wherein the wall engaging portions lie in the same plane as a body of the support.

12. The system of claim 1, wherein the slot has one of an angled configuration, a cross sectional dovetail shape, a cross sectional rectangular or square shape.

13. A picture frame hanging system of claim 1 wherein the support has at least one opening sized to receive a nail extending outwardly from a wall surface, the support being inserted in the slot so that the opening can engage the nail and the picture frame can be held thereon.

14. A wall article hanging system comprising:

a) at least one rail of a wall article, the rail having a slot running along at least a portion of its longitudinal length; and b) at least one frame support, the support sized to fit snugly within the slot so that the support would not fall out of the slot by gravity or be easily moved laterally;

c) when using one support, the support has at least two wall engaging portions, each portion being wire shaped, each wire-shaped portion lying generally in the same plane as the slot when the support is inserted in the slot;

d) the support being inserted in the slot so that the wall engaging portions can engage a wall surface and the wall article can be held thereagainst.

15. The wall article hanging system of claim 14, wherein the wall article is a picture frame.

16. A wall article hanging device for attaching an article to a wall surface comprising an elongated wire having longitudinal axis running generally parallel to the wall surface, means for rigidly and flushly attaching a portion of the wire to a rear surface of the article, ends of the wire being spaced from each other and angled with respect to a plane being generally perpendicular to the wall surface so that each end can penetrate a wall surface after the elongated wire is fastened to the article.

17. The wall article of claim 16, wherein the means comprises one of fasteners and protrusions extending outwardly from the wire in a direction opposite the wire ends.

18. A wall article hanging system comprising:

a) at least one rail of a wall article, the rail having a slot running along at least a portion of its longitudinal length; and b) at least one article support, the support sized to fit snugly within the slot so that the support would not fall out of the slot by gravity or be easily moved laterally;

c) when using one support, the support has at least two wall engaging portions, each portion having at least one planar surface, the planar surface lying generally in the same plane as the slot when the support is inserted in the slot;

the support being inserted in the slot so that the wall engaging portions can engage a wall surface and the wall article can be held thereagainst.

19. A method of using the system as described in claim 18, comprising the steps of first inserting the support into the slot and then forcing the wall article against the wall surface in a desired location, during the forcing step, the wall engaging portions of the support penetrating the wall surface, preferably a dry wall surface, the wall article then secured in place, generally flush the wall and secured against tilting by the two wall engaging portions being engaging in wall surface.

20. The method of claim 19, wherein the wall article is made level to the horizon prior to the forcing step.

21. The method of claim 19, wherein the wall article is made level with respect to a piece of furniture positioned adjacent the wall surface and beneath the desired location.

* * * * *